US007408294B2

(12) United States Patent
Okabe et al.

(10) Patent No.: US 7,408,294 B2
(45) Date of Patent: Aug. 5, 2008

(54) SPARK PLUG WITH HIGH CAPABILITY TO IGNITE AIR-FUEL MIXTURE

(75) Inventors: Shinichi Okabe, Aichi-ken (JP); Tsunenobu Hori, Susono (JP)

(73) Assignees: Denso Corporation (JP); Nippon Soken, Inc. (JP)

( * ) Notice: Subject to any disclaimer, the term of this patent is extended or adjusted under 35 U.S.C. 154(b) by 550 days.

(21) Appl. No.: 11/197,437

(22) Filed: Aug. 5, 2005

(65) Prior Publication Data

US 2006/0028108 A1 Feb. 9, 2006

(30) Foreign Application Priority Data

Aug. 6, 2004 (JP) ..... 2004-231139

(51) Int. Cl.
*H01J 13/20* (2006.01)

(52) U.S. Cl. ..... 313/143

(58) Field of Classification Search ..... 313/143
See application file for complete search history.

(56) References Cited

U.S. PATENT DOCUMENTS 6,552,476 B1 * 4/2003 Hanashi et al. ..... 313/141
6,559,579 B2 5/2003 Ito et al.
7,262,547 B2 * 8/2007 Klett et al. ..... 313/143

FOREIGN PATENT DOCUMENTS

| | | |
|---|---|---|
| DE | 764 397 | 8/1951 |
| DE | 101 56 949 B4 | 6/2003 |
| JP | 60-235379 | 11/1985 |

OTHER PUBLICATIONS

German Office Action issued on Feb. 19, 2007 in corresponding German Application No. 10 2005 036 971.5-23, together with a English translation.

* cited by examiner

*Primary Examiner*—Nimeshkumar D. Patel
*Assistant Examiner*—Anthony T Perry
(74) *Attorney, Agent, or Firm*—Nixon & Vanderhye PC

(57) ABSTRACT

A spark plug according to the invention includes a metal shell, a hollow insulator, a center electrode, and a ground electrode. The insulator has a first end protruding into a combustion chamber of an engine and a second end opposite to the first end in the lengthwise direction of the insulator. The insulator increases in outer diameter from the edge of the inner surface thereof at the first end to a reference plane that is defined to extend perpendicular to the lengthwise direction of the insulator and away 0.1 mm from the edge of the inner surface of the insulator toward the second end of the same in the lengthwise direction. Further, a first volume V1, which is the volume of a portion of the insulator between the edge of the inner surface of the insulator and the reference plane, is in the range of 0.15 to 0.38 $mm^3$.

15 Claims, 9 Drawing Sheets

SPARK PLUG WITH HIGH CAPABILITY TO IGNITE AIR-FUEL MIXTURE

CROSS-REFERENCE TO RELATED APPLICATION

This application claims priority from Japanese Patent Application No. 2004-231139, filed on Aug. 6, 2004, the content of which is hereby incorporated by reference into this application.

BACKGROUND OF THE INVENTION

1. Technical Field of the Invention

The present invention relates generally to spark plugs for use in internal combustion engines of automobiles and cogeneration systems.

More particularly, the invention relates to a spark plug with an improved structure that ensures a high capability of the spark plug to ignite the air-fuel mixture (referred to as ignition capability of the spark plug hereinafter).

2. Description of the Related Art

Conventional spark plugs for use in internal combustion engines generally include a tubular metal shell, an insulator, a center electrode, and a ground electrode.

The tubular metal shell has a threaded portion for fitting the spark plug into a combustion chamber of the engine.

The insulator has a center bore formed therethrough; it is fixed in the metal shell such that an end thereof protrudes from an end of the metal shell.

The center electrode is secured in the center bore of the insulator and has an end that protrudes from the end of the insulator.

The ground electrode has a base end joined to the end of the metal shell and a tip portion that faces the end of the center electrode in the axial direction of the insulator through a spark gap.

In recent years, the demand for higher power output and improved fuel economy of internal combustion engines has required increasing the sizes of intake and exhaust valves for the engine and securing a water jacket for cooling of the engine. This results in a decreased space available for installing a spark plug in the engine, thus requiring the spark plug to have a compact (more specifically, slenderized) structure.

Specifically, the threaded portion of the metal shell in a spark plug had a size of M14 as specified in JIS (Japanese Industrial Standards) in the past; however, the threaded portion is now required to have a size less than or equal to M12 as specified in JIS.

In such a compact spark plug 9, as shown in FIG. 13, an insulation distance, which is the minimum distance between the insulator 92 and a base end portion 951 of the ground electrode 95, is accordingly reduced.

Consequently, when carbon has deposited on the surface of the insulator 92, instead of normal sparks to be discharged across the spark gap G, "side sparks" P can be discharged. The side sparks P, here, denote sparks which creep from the center electrode 93 along the outer surface of the insulator 92, and jump to the base end portion 951 of the ground electrode 95.

More specifically, in the case that the surface of the insulator 92 has been fouled with carbon that is electrically conductive, the electrical potential on the outer surface of the insulator 92 increases when an electrical voltage is applied between the center electrode 93 and the ground electrode 95. Then, when the electrical potential has increased above a certain level, the side sparks P can be discharged across the air gap between the outer surface of the insulator 92 and the base end portion 951 of the ground electrode 95.

Unlike normal sparks, the side sparks P cannot reliably ignite the air-fuel mixture in the combustion chamber of the engine, thus decreasing the ignition capability of the spark plug.

Accordingly, side sparks have become a great obstacle to development of compact spark plugs.

To prevent side sparks from occurring, Japanese Patent First Publication No. S60-235379 discloses a spark plug that has properly specified dimensional parameters such as the end diameter of the insulator.

However, in the disclosed spark plug, the insulator has a long portion that is to protrude into the combustion chamber of the engine. Consequently, though side sparks can be prevented from occurring, it is still difficult to secure a high ignition capability of the spark plug.

More specifically, since the portion of the insulator protruding into the combustion chamber is made long, the length from the end of the insulator to the area where the insulator is connected to the metal shell through a metal ring is accordingly long.

As a result, the temperature at the end of the insulator will be high, so that it becomes difficult for carbon to deposit on the surface of the insulator, thus preventing side sparks from occurring.

However, at the same time, the high temperature at the end of the insulator may cause a pre-ignition of the air-fuel mixture, thus decreasing the ignition capability of the spark plug.

Moreover, since the portion of the insulator protruding into the combustion chamber is made long, the space S between the insulator and the ground electrode as shown in FIG. 13 is accordingly small.

As a result, it becomes difficult for the initial flame to propagate, thus decreasing the ignition capability of the spark plug.

Accordingly, it is desired to prevent side sparks from occurring without making the portion of the insulator protruding into the combustion chamber long.

SUMMARY OF THE INVENTION

The present invention has been made in view of the above-mentioned problem.

It is, therefore, a primary object of the present invention to provide a spark plug with an improved structure that prevents side sparks from occurring and ensures a high ignition capability of the spark plug.

According to the first aspect of the present invention, a spark plug is provided which includes a tubular metal shell, an insulator, a center electrode, and a ground electrode.

The tubular metal shell has an end.

The insulator has a length and a first end and a second end that are opposite to each other in the lengthwise direction of the insulator. The insulator also has a bore that extends in the lengthwise direction of the insulator. The insulator is fixed in the metal shell such that the first end thereof protrudes from the end of the metal shell.

The center electrode is secured in the bore of the insulator and has an end that protrudes from the first end of the insulator.

The ground electrode has a base end joined to the end of the metal shell and a tip portion that faces the end of the center electrode in the lengthwise direction of the insulator through a spark gap.

In the above spark plug, the insulator increases in outer diameter from the edge of the inner surface of the insulator at the first end of the insulator to a first reference plane that is defined to extend perpendicular to the lengthwise direction of the insulator and away 0.1 mm from the edge of the inner surface of the insulator toward the second end of the insulator in the lengthwise direction.

Further, in the above spark plug, a first volume V1, which is the volume of a portion of the insulator between the edge of the inner surface of the insulator and the first reference plane, is in the range of 0.15 to 0.38 $mm^3$.

It is preferable that the first volume V1 is in the range of 0.15 to 0.34 $mm^3$.

According to the second aspect of the present invention, in the above spark plug, the insulator increases in outer diameter from the edge of the inner surface of the insulator at the first end of the insulator to a second reference plane that is defined to extend perpendicular to the lengthwise direction of the insulator and away 0.2 mm from the edge of the inner surface of the insulator toward the second end of the insulator in the lengthwise direction.

Further, in the above spark plug, a second volume V2, which is the volume of a portion of the insulator between the edge of the inner surface of the insulator and the second reference plane, is in the range of 0.5 to 0.84 $mm^3$.

It is preferable that the second volume V2 is in the range of 0.5 to 0.79 $mm^3$.

According to the third aspect of the present invention, in the above spark plug, the insulator increases in outer diameter from the edge of the inner surface of the insulator at the first end of the insulator to a third reference plane that is defined to extend perpendicular to the lengthwise direction of the insulator and away 0.3 mm from the edge of the inner surface of the insulator toward the second end of the insulator in the lengthwise direction.

Further, in the above spark plug, a third volume V3, which is the volume of a portion of the insulator between the edge of the inner surface of the insulator and the third reference plane, is in the range of 0.8 to 1.42 $mm^3$.

It is preferable that the third volume V3 is in the range of 0.8 to 1.39 $mm^3$.

According to the fourth aspect of the present invention, in the above spark plug, the minimum distance C between the inner surface of the metal shell and the outer surface of the insulator on a fourth reference plane, which is defined to extend perpendicular to the lengthwise direction of the insulator through the inner edge of the end of the metal shell, is in the range of 0.4 to 1.6 mm.

According to the fifth aspect of the present invention, in the above spark plug, the center electrode includes a base member and a discharge member. The discharge member has a length with a first end representing the end of the center electrode and a second end joined to the base member.

Further, in the above spark plug, a cross sectional area S1 of the discharge member, which is perpendicular to the lengthwise direction of the discharge member, is in the range of 0.1 to 0.8 $mm^2$; a distance F1 from the first end of the discharge member to the base member in the lengthwise direction of the discharge member is in the rang of 0.3 to 1.5 mm.

It is preferable that the discharge member of the center electrode is made of an Ir-based alloy that includes Ir in an amount of greater than 50 weight percent and at least one additive and has a melting point of greater than 2000° C.

It is also preferable that the at least one additive is selected from Pt, Rh, Ni, W, Pd, Ru, Re, Al, $Al_2O_3$, Y, and $Y_2O_3$.

According to the sixth aspect of the present invention, in the above spark plug, the ground electrode includes a base member and a discharge member. The discharge member has a length with a first end facing the end of the center electrode and a second end joined to the base member.

Further, in the above spark plug, a cross sectional area S2 of the discharge member, which is perpendicular to the lengthwise direction of the discharge member, is in the range of 0.1 to 0.8 $mm^2$; a distance F2 from the first end of the discharge member to the base member in the lengthwise direction of the discharge member is in the rang of 0.3 to 1.5 mm.

It is preferable that the discharge member of the ground electrode is made of a Pt-based alloy that includes Pt in an amount of greater than 50 weight percent and at least one additive and has a melting point of greater than 1500° C.

It is also preferable that the at least one additive is selected from Ir, Rh, Ni, W, Pd, Ru, and Re.

According to the seventh aspect of the present invention, in the above spark plug, the minimum wall thickness T of the insulator on the fourth reference plane is in the range of 0.3 to 1.8 mm.

It is preferable that on the fourth reference plane, the outer diameter d of the center electrode is in the range of 0.8 to 2.6 mm.

Through specifying the effective ranges of the dimensional parameters V1, V2, V3, C, F1, S1, F2, S2, T and d as above, side sparks are prevented from occurring in the spark plug and a high ignition capability of the spark plug is ensured.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DESCRIPTION OF THE PREFERRED EMBODIMENTS

Figure 1:
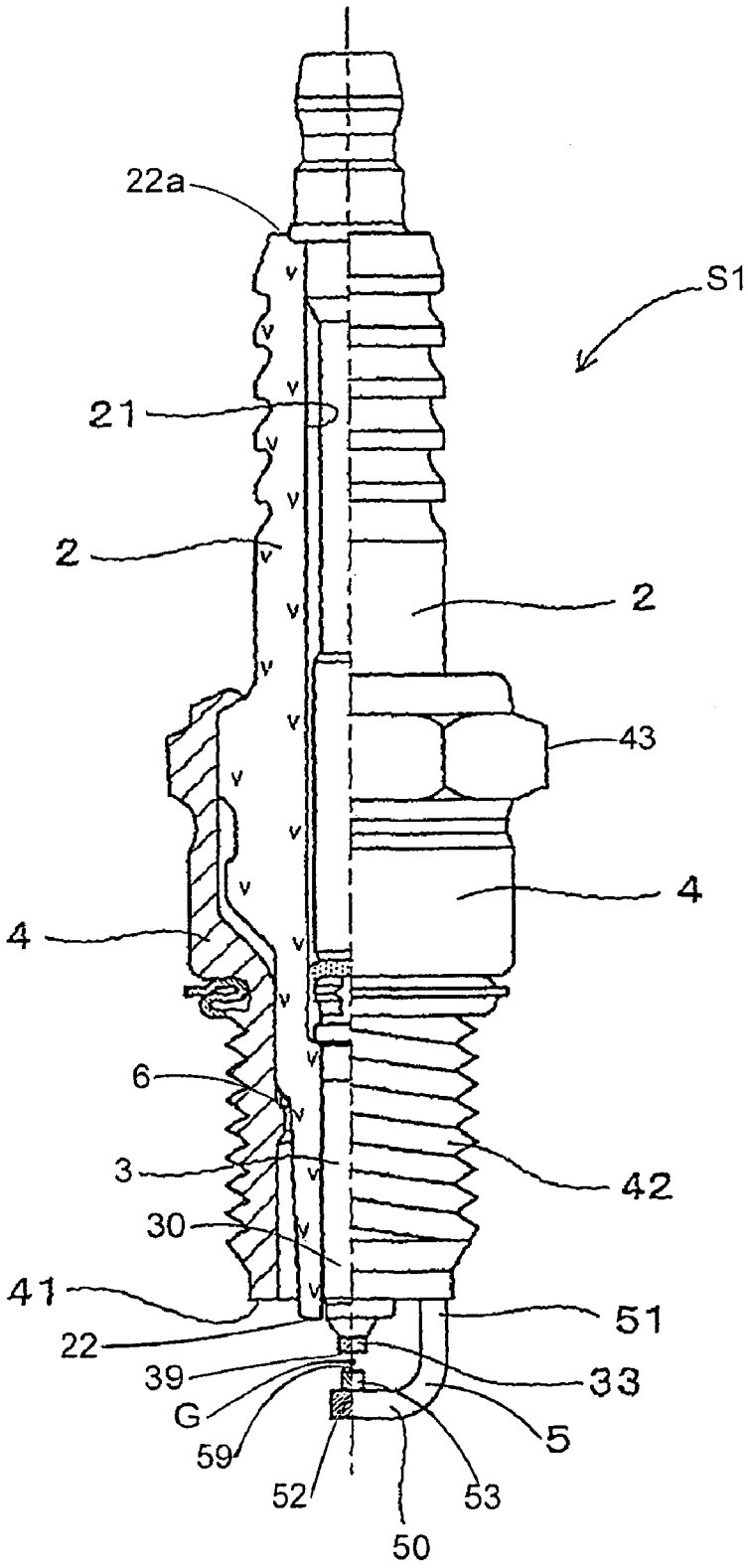
FIG. 1 is a partially cross-sectional side view showing the overall structure of a spark plug according to the first embodiment of the invention.

The preferred embodiments of the present invention will be described hereinafter with reference to FIGS. 1-12.

It should be noted that, for the sake of clarity and understanding, identical components having identical functions in different embodiments of the invention have been marked, where possible, with the same reference numerals in each of the figures.

First Embodiment

FIG. 1 shows the overall structure of a spark plug S1 according to the first embodiment of the invention. The spark plug S1 is designed for use in internal combustion engines of automotive vehicles.

As shown in FIG. 1, the spark plug S1 includes an insulator 2, a center electrode 3, a tubular metal shell 4, and a ground electrode 5.

The tubular metal shell 4 has a male threaded portion 42 formed on an outer periphery thereof and a hexagonal head portion 43. The male threaded portion 42 has a size in the range of M8 to M14 as specified in JIS. The metal shell 4 is made of a conductive metal material, for example low-carbon steel.

The installation of the spark plug S1 in an internal combustion engine is achieved by fitting it into a combustion chamber (not shown) of the engine. More specifically, in the installation, the hexagonal head portion 43 is torqued so as to establish an engagement between the male threaded portion 42 of the metal shell 4 and a female threaded bore provided in the cylinder head (not shown) of the combustion chamber.

The insulator 2 has a first end 22 and a second end 22*a* that are opposite to each other in the lengthwise direction of the insulator 2. The insulator 2 also has a through-bore 21 that extends in the lengthwise direction of the insulator 2. The insulator 2 is fixed and partially contained in the metal shell 4 such that the first end 22 of the insulator 2 protrudes from an end 41 of the metal shell 4. The insulator 2 is made of alumina ceramic ($Al_2O_3$).

Between the insulator 2 and the metal shell 4, there is provided a metal ring 6 through which heat is to be transferred from the insulator 2 to the metal shell 4, thereby reducing the temperature of the insulator 2.

The cylindrical center electrode 3 is secured in the through-bore 21 of the insulator 2, so that it is electrically isolated from the metal shell 4. The center electrode 3 is partially included in the metal shell 4 together with the insulator 2 such that an end 39 of the center electrode 3 protrudes from the first end 22 of the insulator 2.

In this embodiment, the center electrode 3 consists of a base member 30 and a discharge member 33.

The base member 30 is made of a highly heat conductive metal material such as Cu as the core material and a highly heat-resistant, corrosion-resistant metal material such as a Ni (Nickel)-based alloy as the cladding material.

The discharge member 33 has a first end representing the end 39 of the center electrode 3 and a second end that is joined, for example by laser welding, to the base member 30.

The discharge member 33 is preferably made of an Ir (Iridium)-based alloy that includes Ir in an amount of greater than 50 weight percent and at least one additive; the melting point of the Ir-based alloy is greater than 2000° C.

Further, the at least one additive for the discharge member 33 is preferably selected from Pt (Platinum), Rh (Rhodium), Ni, W (Tungsten), Pd (Palladium), Ru (Ruthenium), Re (Rhenium), Al (Aluminum), $Al_2O_3$ (Alumina), Y (Yttrium), and $Y_2O_3$ (Yttria).

Specifying the material of the discharge member 33 as above, the durability of the discharge member 33 is secured. Moreover, the discharge member 33 is allowed to have dimensional parameters as to be descried below.

The ground electrode 5 has a base end portion 51 that is joined, for example by resistance welding, to the end 41 of the metal shell 4. The ground electrode 5 also has a tip portion 52 that faces the end 39 of the center electrode 3 in the lengthwise direction of the insulator 2 through a spark gap G.

In this embodiment, the ground electrode 5 consists of a base member 50 and a discharge member 53.

The base member 50 is column-shaped, for example an approximately L-shaped prism in this embodiment. The base member 50 is made of a Ni-based alloy consisting mainly of Ni.

The discharge member 53 has a cylindrical shape; it has a first end 59 facing the end 39 of the center electrode 3 through the spark gap G and a second end that is joined, for example by laser welding, to the base member 50.

The discharge member 53 is preferably made of a Pt-based alloy that includes Pt in an amount of greater than 50 weight percent and at least one additive; the melting point of the Pt-based alloy is greater than 1500° C.

Further, the at least one additive for the discharge member 53 is preferably selected from Ir, Rh, Ni, W, Pd, Ru, Re.

Specifying the material of the discharge member 53 as above, the durability of the discharge member 53 is secured. Moreover, the discharge member 53 is allowed to have dimensional parameters as to be descried below.

The spark plug S1 is configured to discharge sparks across the spark gap G between the end 39 of the center electrode 3 and the end 59 of the ground electrode 5, thereby igniting the air/fuel mixture within the combustion chamber of the engine.

Having described the overall structure of the spark plug S1, dimensional parameters V1, V2, V3, C, T, d, F1, S1, F2, and S2, which are critical to the ignition capability of the spark plug S1, will be defined and specified hereinafter.

Figure 2:
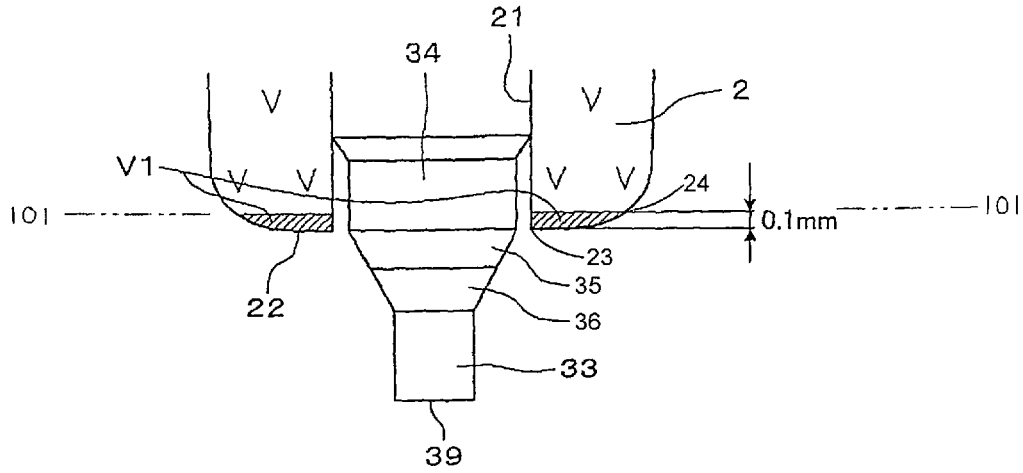
FIG. 2 is an enlarged partially cross-sectional side view illustrating the first volume V1 in the spark plug of FIG. 1.

Referring to FIG. 2, the insulator 2 increases in outer diameter from the edge of the inner surface of the insulator 2 at the first end 22 (i.e., the inner edge of the first end 22) to a first reference plane 101. The first reference plane 101 is defined to extend perpendicular to the lengthwise direction of the insulator 2 and away 0.1 mm from the edge of the inner surface of the insulator 2 in the lengthwise direction.

The parameter V1 is defined as the volume of an end portion of the insulator 2 between the edge of the inner surface of the insulator 2 and the first reference plane 101. The parameter V1 is to be simply referred to as a first volume V1 hereinafter.

The end portion, which is indicated with hatching in FIG. 2, is approximately arc-shaped in any longitudinal cross section of the insulator 2. The end portion includes an inner end portion 23 around the inner edge of the first end 22 and an outer end portion 24 around the line of intersection between the outer surface of the insulator 2 and the first reference plane 101.

In this embodiment, the first volume V1 is specified, through experimental investigation, to be in the range of 0.15 to 0.38 $mm^3$.

Through specifying the above range, the side sparks P are prevented from occurring, which otherwise may be discharged across the air gap between the outer surface of the insulator 2 and the base end portion 51 of the ground electrode 5.

More specifically, since the outer diameter of the insulator 2 increases from the inner edge of the first end 22 to the first reference plane 101, the inner end portion 23 will protrude into the combustion chamber of the engine more deeply than any other portion of the insulator 2. Moreover, since the first volume V1 is so small as to be not greater than 0.38 mm, the thermal capacity of the inner end portion 23 is sufficiently small. Consequently, the inner end portion 23 will be easily heated to a high temperature, so that it is possible to burn off the carbon that has adhered to the inner end portion 23, thus preventing carbon from depositing thereon.

Accordingly, even if carbon has deposited on the outer end portion 24, a large insulation resistance can be secured between the center electrode 3 and the outer end portion 24. Thus, when an electrical voltage is applied between the center electrode 3 and the ground electrode 5, the electrical potential on the outer end portion 24, from which the side sparks P otherwise may be discharged, will be very low. As a result, the side sparks P are prevented from occurring, and normal sparks will be discharged across the spark gap G.

Further, in conventional spark plugs, pre-ignition of the air-fuel mixture generally initiates from the outer end portion 24 at which the temperature of the insulator is highest. However, in the spark plug S1 according to the present embodiment, the inner end portion 23 can be heated to a high temperature without making the portion of the insulator 2 protruding into the combustion chamber of the engine long. Thus, the temperature of the outer end portion 24 can be suppressed, so that pre-ignition of the air fuel mixture can be prevented from occurring.

Furthermore, in the spark plug S1, since the portion of the insulator 2 protruding into the combustion chamber of the engine is kept short and the first volume V1 is made small, a sufficient space between the insulator 2 and the ground electrode 5 is secured for propagation of the initial flame. As a result, the ignition capability of the spark plug S1 is prevented from being decreased due to insufficient space for propagation of the initial flame.

Accordingly, through specifying the upper limit of the first volume V1 as above, the side sparks P are prevented from occurring and a high ignition capability of the spark plug S1 is ensured.

It is preferable that the first volume V1 is less than or equal to 0.34 $mm^3$, so as to more reliably prevent the side sparks P from occurring and ensure a high ignition capability of the spark plug S1.

On the contrary, through specifying the lower limit of the first volume V1 as above, a sufficient strength of the end portion of the insulator 2 is secured.

Figure 3:
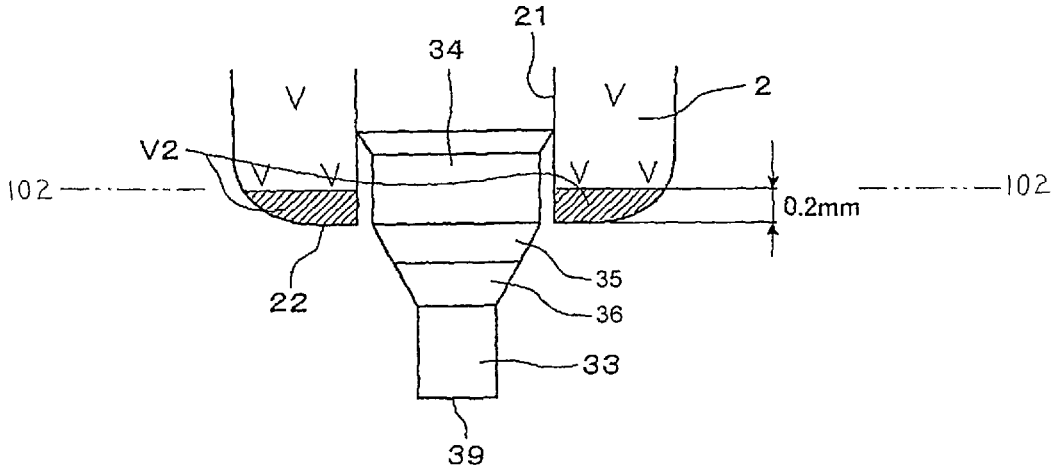
FIG. 3 is an enlarged partially cross-sectional side view illustrating the second volume V2 in the spark plug of FIG. 1.

Referring to FIG. 3, the insulator 2 increases in outer diameter from the edge of the inner surface of the insulator 2 at the first end 22 to a second reference plane 102. The second reference plane 102 is defined to extend perpendicular to the lengthwise direction of the insulator 2 and away 0.2 mm from the edge of the inner surface of the insulator 2 in the lengthwise direction.

The parameter V2 is defined as the volume of that portion of the insulator 2 between the edge of the inner surface of the insulator 2 and the second reference plane 102, which is indicated with hatching in FIG. 3. The parameter V2 is to be simply referred to as a second volume V2 hereinafter.

In this embodiment, the second volume V2 is specified, through experimental investigation, to be in the range of 0.5 to 0.84 $mm^3$.

Through specifying the upper limit of the second volume V2 as above, the side sparks P are more reliably prevented from occurring and the ignition capability of the spark plug S1 is more reliably ensured.

It is preferable that the second volume V2 is less than or equal to 0.79 $mm^3$.

On the contrary, through specifying the lower limit of the second volume V2 as above, a sufficient strength of that portion of the insulator 2 between the edge of the inner surface of the insulator 2 and the second reference plane 102 is secured.

Figure 4:
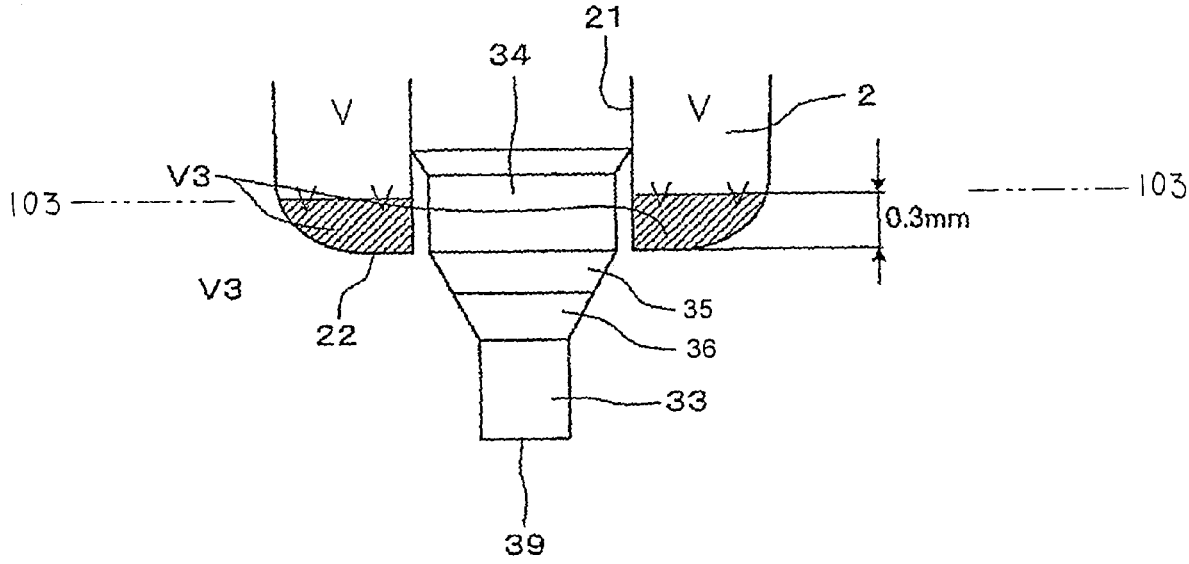
FIG. 4 is an enlarged partially cross-sectional side view illustrating the third volume V3 in the spark plug of FIG. 1.

Referring to FIG. 4, the insulator 2 increases in outer diameter from the edge of the inner surface of the insulator 2 at the first end 22 to a third reference plane 103. The third reference plane 103 is defined to extend perpendicular to the lengthwise direction of the insulator 2 and away 0.3 mm from the edge of the inner surface of the insulator 2 in the lengthwise direction.

The parameter V3 is defined as the volume of that portion of the insulator 2 between the edge of the inner surface of the insulator 2 and the third reference plane 103, which is indicated with hatching in FIG. 4. The parameter V3 is to be simply referred to as a third volume V3 hereinafter.

In this embodiment, the third volume V3 is specified, through experimental investigation, to be in the range of 0.8 to 1.42 $mm^3$.

Through specifying the upper limit of the third volume V3 as above, the side sparks P are more reliably prevented from occurring and the ignition capability of the spark plug S1 is more reliably ensured.

It is preferable that the third volume V3 is less than or equal to 1.39 $mm^3$.

On the contrary, through specifying the lower limit of the third volume V3 as above, a sufficient strength of that portion of the insulator 2 between the edge of the inner surface of the insulator 2 and the third reference plane 103 is secured.

Figure 5:
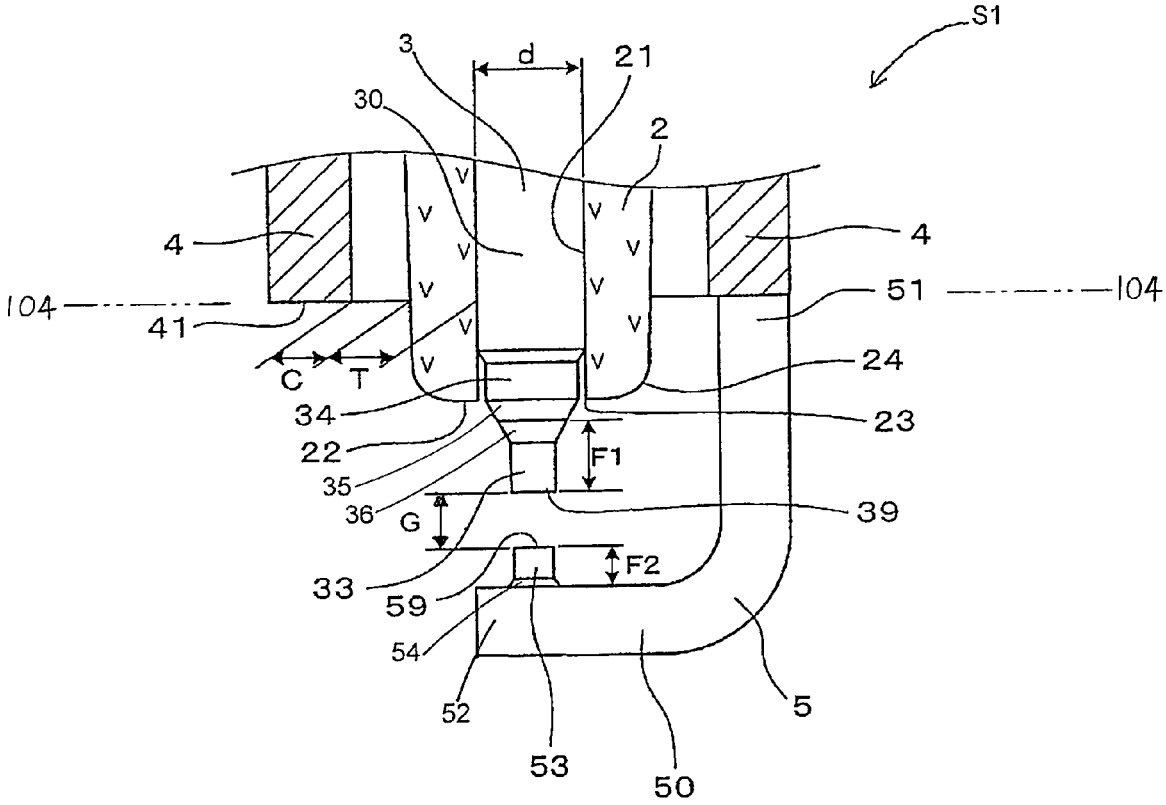
FIG. 5 is an enlarged partially cross-sectional side view showing an end portion of the spark plug of FIG. 1.

Referring to FIG. 5, the parameter C is defined as the minimum distance between the inner surface of the metal shell 4 and the outer surface of the insulator 2 on a fourth reference plane 104. The fourth reference plane 104 is defined to extend perpendicular to the lengthwise direction of the insulator 2 through the inner edge of the end 41 of the metal shell 4. The parameter C is to be simply referred to as a distance C hereinafter.

In this embodiment, the distance C is specified to be in the range of 0.4 to 1.6 mm.

Through specifying the above range, the insulation resistance between the center electrode 3 and the metal shell 4 is secured, the insulator 2 is prevented from being fouled with carbon, and the ignition capability of the spark plug S1 is ensured.

This is because if the distance C is above the upper limit, it is easy for carbon to flow into the inside of an air gap formed between the outer surface of the insulator 2 and the inner surface of the metal shell 4. Consequently, carbon will easily deposit on the inside section of the outer surface of the insulator 2, thus causing the insulator 2 to be fouled with carbon and the insulation resistance between the center electrode 3 and the metal shell 4 to be decreased.

On the contrary, if the distance C is below the lower limit, side sparks will be easily discharged from the insulator 2 to the metal shell 4 when the insulator 2 has been fouled with carbon, thus decreasing the ignition capability of the spark plug S1.

The parameter T is defined, as shown in FIG. 5, as the minimum wall thickness of the insulator 2 on the fourth reference plane 104. The parameter T is to be simply referred to as a wall thickness T of the insulator 2 hereinafter.

In this embodiment, the wall thickness T of the insulator 2 is specified to be in the range of 0.3 to 1.8 mm.

Through specifying the upper limit of the wall thickness T of the insulator 2 as above, the thermal capacity of the insulator 2 is kept small enough to burn off the carbon that has adhered to the insulator 2, thus preventing the insulator 2 from being fouled with carbon.

On the contrary, through specifying the lower limit of the wall thickness T of the insulator 2 as above, a sufficient insulation resistance between the center electrode 3 and the ground electrode 5 is secured.

The parameter d is defined, as shown in FIG. 5, as the outer diameter of the center electrode 3 on the fourth reference plane 104. The parameter d is to be simply referred to as a diameter d of the center electrode 3 hereinafter.

In this embodiment, the diameter d of the center electrode 3 is specified to be in the range of 0.8 to 2.6 mm.

Through specifying the upper limit of the diameter d of the center electrode 3 as above, the spark plug S1 is allowed to be compact.

On the contrary, through specifying the lower limit of the diameter d of the center electrode 3 as above, it becomes possible to secure the heat range of the spark plug S1, reliably prevent pre-ignition of the air-fuel mixture, and ensure the durability of the center electrode 3.

As described previously, the center electrode 3 consists of the base member 30 and the discharge member 33. The base member 30 includes, as shown in FIG. 5, a small diameter portion 34, which has an outer diameter smaller than the above-defined diameter d of the center electrode 3, and a diameter-reducing portion 35 that tapers toward the end 39 of the center electrode 3. The diameter-reducing portion 35 has an end to which the second end of the discharge member 33 is joined by laser welding. Accordingly, there is a weld layer 36 formed between the diameter-reducing portion 35 and the discharge member 33.

The parameter F1 is defined, as shown in FIG. 5, as a distance from the diameter-reducing portion 35 of the base member 30 to the first end of the discharge member 33 (i.e., the end 39 of the center electrode 3) in the lengthwise direction of the discharge member 33. The parameter F1 is to be simply referred to as a length F1 of the discharge member 33 hereinafter.

In this embodiment, the length F1 of the discharge member 33 is specified to be in the range of 0.3 to 1.5 mm.

Through specifying the above range, the durability of the discharge member 33 is secured and the ignition capability of the spark plug S1 is ensured.

This is because if the length F1 of the discharge member 33 is above the upper limit, the temperature at the first end of the discharge member 33 will be too high, so that wear of the discharge member 33 is facilitated due to hot-gas corrosion. On the contrary, if the length F1 of the discharge member 33 is below the lower limit, the initial flame will make contact with the base member 30, thus being quickly cooled down. As a result, the ignition capability of the spark plug S1 is decreased.

The parameter S1 is defined as a cross sectional area of the discharge member 33 perpendicular to the lengthwise direction of the discharge member 33. The parameter S1 is to be simply referred to as a cross sectional area S1 of the discharge member 33 hereinafter.

In this embodiment, the cross sectional area S1 of the discharge member 33 is specified to be in the range of 0.1 to 0.8 $mm^2$.

Through specifying the above range, the durability of the discharge member 33 is secured and the ignition capability of the spark plug S1 is ensured.

This is because if the cross sectional area S1 of the discharge member 33 is above the upper limit, the initial flame will be quickly cooled down by the discharge member 33, thus decreasing the ignition capability of the spark plug S1. On contrary, if the cross sectional area S1 of the discharge member 33 is below the lower limit, the discharge member 33 will be easily worn down.

Moreover, through specifying both the ranges of F1 and S1 as above, the discharge member 33 is slenderized. As a result, the strength of the electrical field at the first end of the discharge member 33 will be increased, so that the required ignition voltage of the spark plug S1 (i.e., the electrical voltage required to discharge normal sparks across the spark gap G) can be decreased, thereby effectively preventing the side sparks P from occurring.

Similar to the above-described weld layer 36, as shown in FIG. 5, there is another weld layer 54 formed between the base member 50 and discharge member 53 of the ground electrode 5.

The parameter F2 is defined as a distance from the base member 50 to the first end 59 of the discharge member 53 in the lengthwise direction of the discharge member 53. The parameter F2 is to be simply referred to as a length F2 of the discharge member 53 hereinafter.

In this embodiment, the length F2 of the discharge member 53 is specified to be in the range of 0.3 to 1.5 mm.

Through specifying the above range, the durability of the discharge member 53 is secured and the ignition capability of the spark plug S1 is ensured.

This is because if the length F2 of the discharge member 53 is above the upper limit, the temperature at the first end 59 of the discharge member 53 will be too high, so that wear of the discharge member 53 is facilitated due to hot-gas corrosion. On the contrary, if the length F2 of the discharge member 53 is below the lower limit, the initial flame will make contact with the base member 50, thus being quickly cooled down. As a result, the ignition capability of the spark plug S1 is decreased.

The parameter S2 is defined as a cross sectional area of the discharge member 53 perpendicular to the lengthwise direction of the discharge member 53. The parameter S2 is to be simply referred to as a cross sectional area S2 of the discharge member 53 hereinafter.

In this embodiment, the cross sectional area S2 of the discharge member 53 is specified to be in the range of 0.1 to 0.8 $mm^2$.

Through specifying the above range, the durability of the discharge member 53 is secured and the ignition capability of the spark plug S1 is ensured.

This is because if the cross sectional area S2 of the discharge member 53 is above the upper limit, the initial flame will be quickly cooled down by the discharge member 53, thus decreasing the ignition capability of the spark plug S1. On contrary, if the cross sectional area S2 of the discharge member 53 is below the lower limit, the discharge member 53 will be easily worn down.

Moreover, through specifying both the ranges of F2 and S2 as above, the discharge member 53 is slenderized. As a result, the required ignition voltage of the spark plug S1 can be decreased, thereby effectively preventing the side sparks P from occurring.

To sum up, the spark plug S1 according to the present embodiment has an improved structure, where the first volume V1, second volume V2, third volume V3, distance C, wall thickness T of the insulator 2, diameter d of the center electrode 3, length F1 of the discharge member 33, cross sectional area S1 of the discharge member 33, length F2 of the discharge member 53, and cross sectional area S2 of the discharge member 53 are specified to be in the following ranges:

$0.15\ mm^3 \leqq V1 \leqq 0.38\ mm^3$;

(preferably, $0.15\ mm^3 \leqq V1 \leqq 0.34\ mm^3$)

$0.5\ mm^3 \leqq V2 \leqq 0.84\ mm^3$;

(preferably, $0.5\ mm^3 \leqq V2 \leqq 0.79\ mm^3$)

$0.8\ mm^3 \leqq V3 \leqq 1.42\ mm^3$;

(preferably, $0.8\ mm^3 \leqq V3 \leqq 1.39\ mm^3$)

$0.4\ mm \leqq C \leqq 1.6\ mm$;

$0.3\ mm \leqq T \leqq 1.8\ mm$;

$0.8\ mm \leqq d \leqq 2.6\ mm$;

$0.3\ mm \leqq F1 \leqq 1.5\ mm$;

$0.1\ mm^2 \leqq S1 \leqq 0.8\ mm^2$;

$0.3\ mm \leqq F2 \leqq 1.5\ mm$; and $0.1\ mm^2 \leqq S2 \leqq 0.8\ mm^2$.

Through specifying the above ranges, side sparks are prevented from occurring in the spark plug S1 and a high ignition capability of the spark plug S1 is ensured.

Among the above ranges, those of the first volume v1, second volume V2, and third volume V3 have been specified through the experiments to be described below.

EXPERIMENT 1

This experiment was conducted to determine the relationships between the first volume V1 and the insulation resistance of the spark plug S1 and between the first volume V1 and the occurrence rate of side sparks in the spark plug S1.

Sample spark plugs having different values of the first volume V1 were fabricated for the experiment, in each of which: the outer diameter of the insulator 2 at the position away 0.4 mm from the first end 22 of the insulator 2 in the lengthwise direction of the same is 3.4 mm; the wall thickness of the insulator 2 at the same position is 0.64 mm; the diameter d of the center electrode 3 is 2.1 mm; the size of the threaded portion 42 of the metal shell 4 is M10; the distance C is 1.6 mm; the cross sectional area S1 of the discharge member 33 is $0.24\ mm^2$; the length F1 of the same is 1.0 mm; the cross sectional area S2 of the discharge member 53 is 0.38 $mm^2$; the length F2 of the same is 1.0 mm; and the size of the spark gap G is 0.6 mm.

The sample spark plugs were tested in accordance with the carbon-fouling test method specified in JIS-D1606. Then, for each of those tested sample spark plugs, the insulation resistance between the center electrode 3 and ground electrode 5 was measured according to the measurement method specified in JIS B 8031.

Figure 6A:
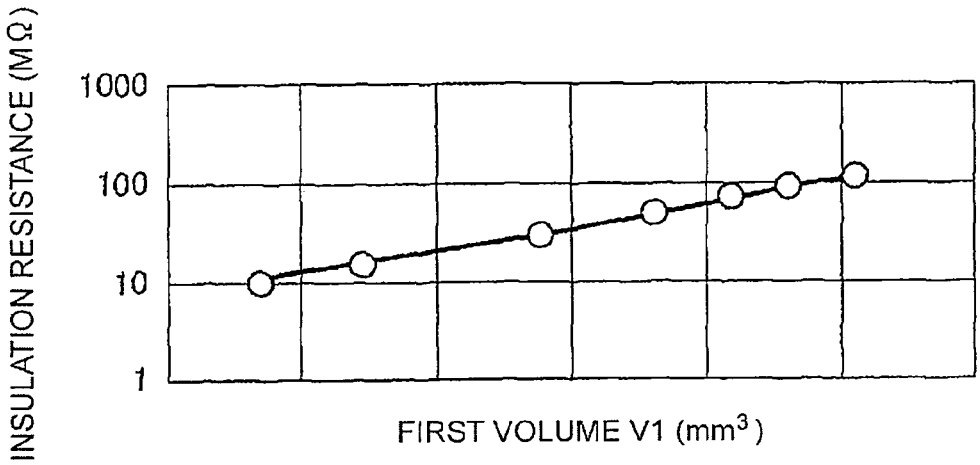
FIG. 6A is a graphical representation showing the relationship between the first volume V1 and the insulation resistance of the spark plug of FIG. 1.

FIG. 6A shows the test results, where the horizontal axis indicates the first volume V1, while the vertical one indicates the resultant insulation resistance.

As seen from FIG. 6A, the insulation resistance increased with the first volume V1.

After the above test, the sample spark plugs, which had been fouled with carbon, were tested under an idle condition for one minute to measure the occurrence rates of side sparks in those sample spark plugs. An occurrence of side sparks during the test was determined based on the waveform of the discharge voltage of the sample spark plug; then the ratio of the number of occurrence of side sparks to the total number of discharge during the test was counted as the occurrence rate of side sparks in the sample spark plug.

Figure 6B:
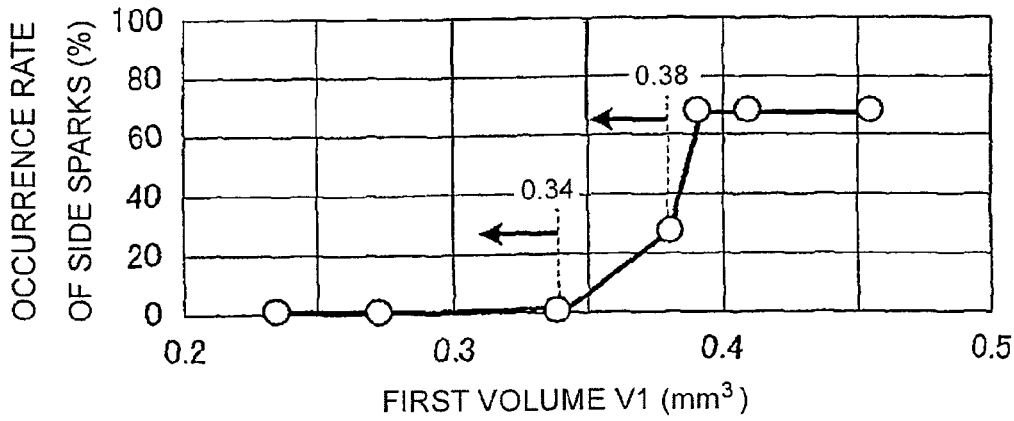
FIG. 6B is a graphical representation showing the relationship between the first volume V1 and the occurrence rate of side sparks in the spark plug of FIG. 1.

FIG. 6B shows the test results, where the horizontal axis indicates the first volume V1, while the vertical one indicates the resultant occurrence rate of side sparks.

As seen from FIG. 6B, the occurrence rate of side sparks decreased with the first volume V1. When the first volume V1 was decreased to $0.38\ mm^3$, side sparks were considerately suppressed. Further, when the first volume V1 was decreased to $0.34\ mm^3$, side sparks were completely suppressed.

The test results shown in FIGS. 6A-6B can be explained, referring further to FIG. 7, as follows.

Figure 7:
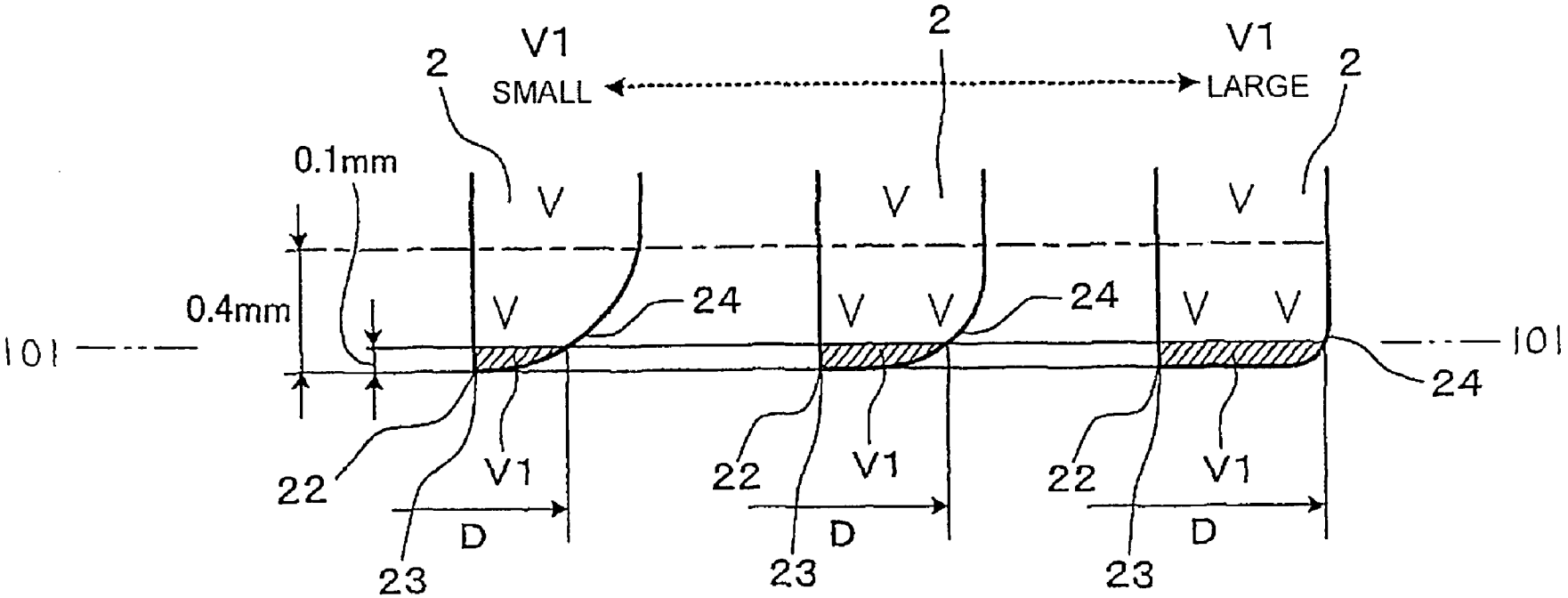
FIG. 7 is a view illustrating the first volume V1 and the shape of an insulator end portion of the spark plug of FIG. 1.

As shown in FIG. 7, the outer diameter D of the insulator 2 on the first reference plane 101 increases with the first volume V1. As the outer diameter D increases, the outer end portion 24 gets more away from the center electrode 3 that serves to transfer heat from the insulator 2 to the outside of the combustion chamber.

Consequently, when the first volume V1 is large, the temperature on the outer end portion 24 will be high, so that it becomes difficult for carbon to deposit thereon. As a result, as shown in FIG. 6A, the insulation resistance between the center electrode 3 and ground electrode 5 can keep high level.

However, at the same time, it becomes difficult to prevent carbon from depositing on the inner end portion 23 and the path from the inner end portion 23 to the outer end portion 24, so that the electrical potential on the outer end portion 24 will become high. As a result, as shown in FIG. 6B, the occurrence rate of side sparks will be accordingly high.

On the contrary, when the first volume V1 is small, it becomes difficult to prevent carbon from depositing on the outer end portion 24. As a result, as shown in FIG. 6A, the insulation resistance between the center electrode 3 and ground electrode 5 will be decreased.

However, at the same time, the temperature on the inner end portion 23 will be high, so that it becomes difficult for carbon to deposit on the inner end portion 23. Consequently, a large insulation resistance can be secured between the center electrode 3 and the outer end portion 24, thus decreasing the electrical potential on the outer end portion 24. As a result, as shown in FIG. 6B, the occurrence rate of side sparks will be accordingly low.

Accordingly, to prevent side sparks from occurring and ensure a high ignition capability of the spark plug S1, it is necessary to specify the first volume V1 to be not greater than $0.38\ mm^3$. Further, it is preferable to specify the first volume V1 to be not greater than $0.34\ mm^3$.

EXPERIMENT 2

This experiment was conducted to investigate the effect of the diameter d of the center electrode 3 on the relationship between the first volume V1 and the occurrence rate of side sparks in the spark plug S1.

Figure 8:
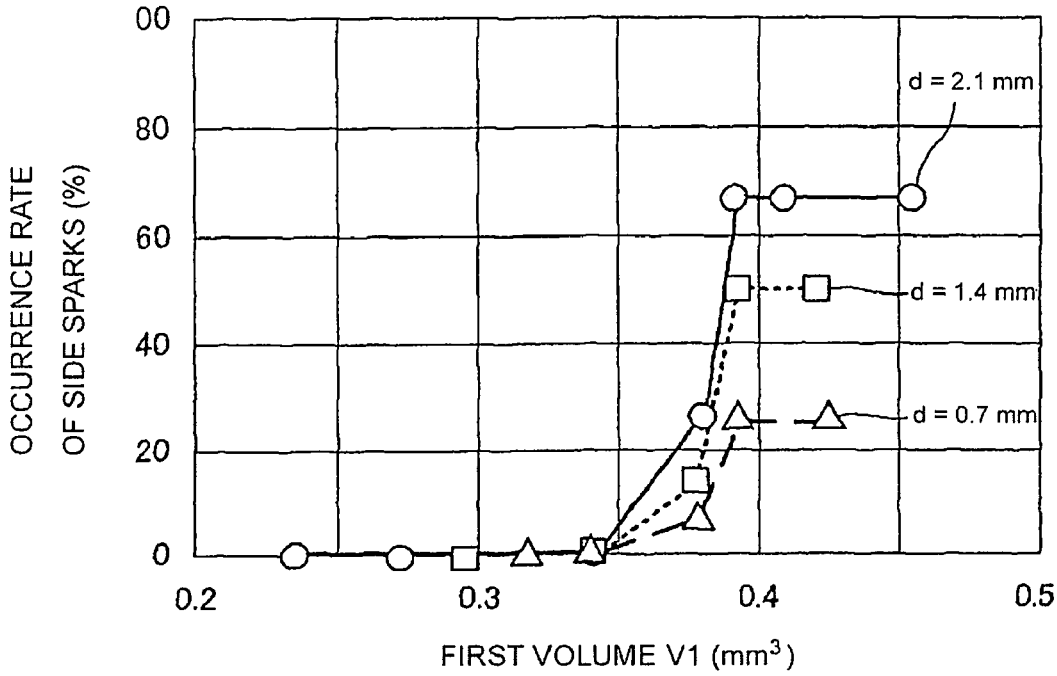
FIG. 8 is a graphical representation showing the effect of the diameter d of the center electrode on the relationship between the first volume V1 and the occurrence rate of side sparks in the spark plug of FIG. 1.

FIG. 8 shows the results of the experiment, where the resultant occurrence rates of side sparks for different diameters d of the center electrode 3 are distinguished with the plots of "○" for 2.1 mm, the plots of "□" for 1.4 mm, and the plots of "Δ" for 0.7 mm.

As seen from FIG. 8, the same tendency was observed for all the different diameters d of the center electrode 3. More specifically, when the first volume V1 was not greater than $0.38\ mm^3$, side sparks were considerably suppressed regardless of the diameter d of the center electrode 3.

The above experimental results can be explained as follows.

As the diameter d of the center electrode 3 decreases, the inner end portion 23 gets more away from the metal shell 5, thus making side sparks difficult to occur.

However, at the same time, to decrease the diameter d of the center electrode 3 without changing the first volume V1, the wall thickness of the end portion of the insulator 2 has to be increased. As a result, it becomes difficult for the inner end portion 23 to be heated to high temperature, thus making it difficult to prevent carbon from depositing on the inner end portion 23.

Consequently, the above two effects of the diameter d of the center electrode 3 are offset by each other, so that the same tendency in occurrence rate of side sparks can be observed for the different diameters d of the center electrode 3.

EXPERIMENT 3

This experiment was conducted, in the same way as the experiment 1, to determine the relationship between the second volume V2 and the occurrence rate of side sparks in the spark plug S1.

Figure 9:
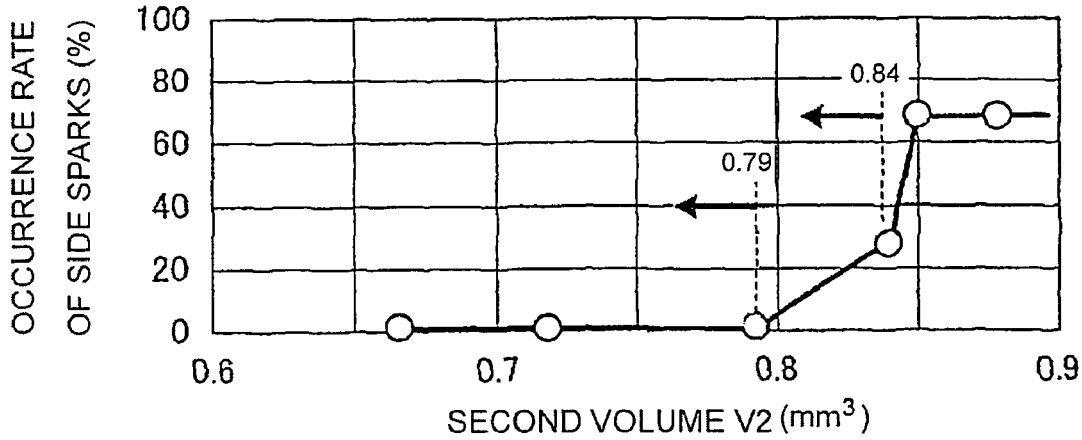
FIG. 9 is a graphical representation showing the relationship between the second volume V2 and the occurrence rate of side sparks in the spark plug of FIG. 1.

FIG. 9 shows the experimental results, where the horizontal axis indicates the second volume V2, while the vertical one indicates the resultant occurrence rate of side sparks.

As seen from FIG. 9, the occurrence rate of side sparks decreased with the second volume V2. When the second volume V2 was decreased to 0.84 $mm^3$, side sparks were considerately suppressed. Further, when the second volume V2 was decreased to 0.79 $mm^3$, side sparks were completely suppressed.

Accordingly, to prevent side sparks from occurring and ensure a high ignition capability of the spark plug S1, it is necessary to specify the second volume V2 to be not greater than 0.84 $mm^3$. Further, it is preferable to specify the second volume V2 to be not greater than 0.79 $mm^3$.

EXPERIMENT 4

This experiment was conducted, in the same way as the experiment 1, to determine the relationship between the third volume V3 and the occurrence rate of side sparks in the spark plug S1.

Figure 10:
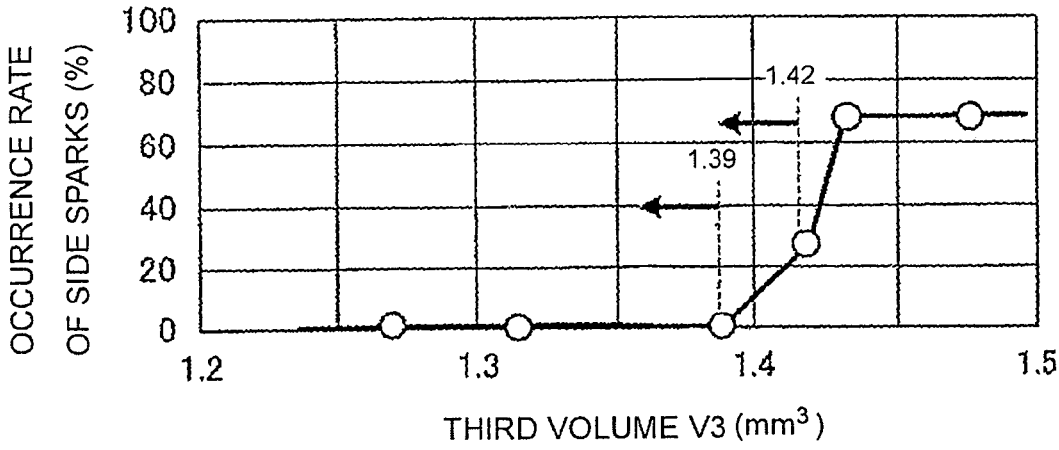
FIG. 10 is a graphical representation showing the relationship between the third volume V3 and the occurrence rate of side sparks in the spark plug of FIG. 1.

FIG. 10 shows the experimental results, where the horizontal axis indicates the third volume V3, while the vertical one indicates the resultant occurrence rate of side sparks.

As seen from FIG. 10, the occurrence rate of side sparks decreased with the third volume V3. When the third volume V3 was decreased to 1.42 $mm^3$, side sparks were considerately suppressed. Further, when the third volume V3 was decreased to 1.39 $mm^3$, side sparks were completely suppressed.

Accordingly, to prevent side sparks from occurring and ensure a high ignition capability of the spark plug S1, it is necessary to specify the third volume V3 to be not greater than 1.42 $mm^3$. Further, it is preferable to specify the third volume V3 to be not greater than 1.39 $mm^3$.

Second Embodiment

This embodiment illustrates a spark plug S2 that has a structure almost identical to that of the spark plug S1 according to the previous embodiment.

Figure 11:
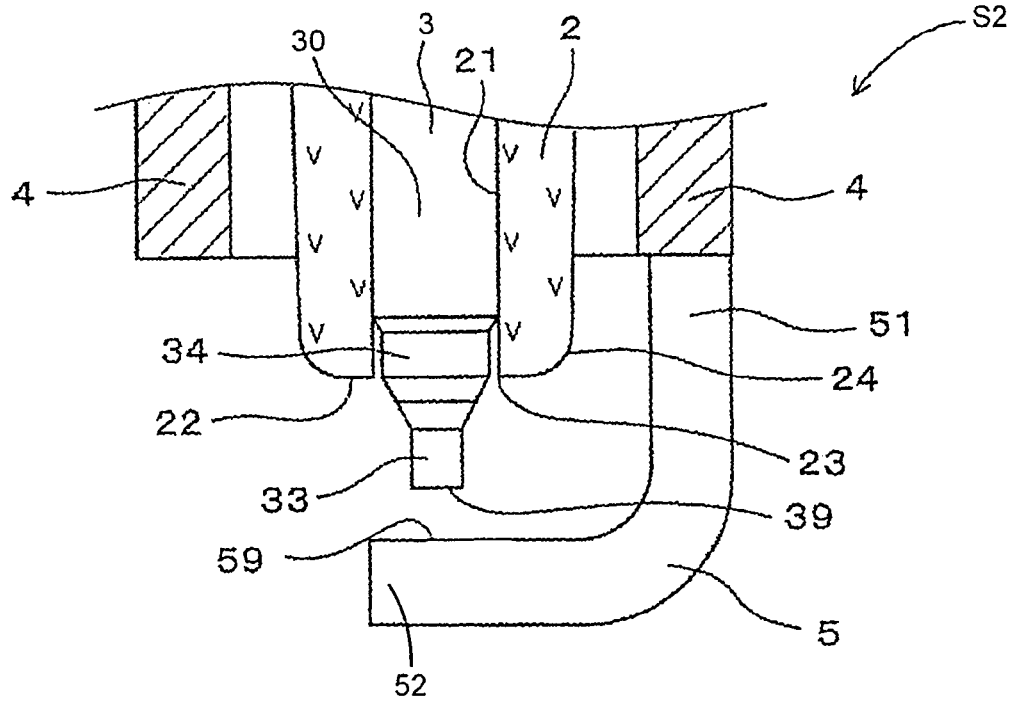
FIG. 11 is an enlarged partially cross-sectional side view showing an end portion of a spark plug according to the second embodiment of the invention.

However, as shown in FIG. 11, the ground electrode 5 of the spark plug S2 has no discharge member 53, so that a side surface 59 of the tip portion 52 of the ground electrode 5 directly faces the end 39 of the center electrode 3.

In such a spark plug S2, dimensional parameters V1, V2, V3, C, T, d, F1, and S1 have the same definitions as in the spark plug S1.

Further, in the spark plug S2, the above parameters have been specified to be in the same ranges as in the spark plug S1, so that the effects described in the previous embodiment are also obtainable with the spark plug S2.

EXPERIMENT 5

This experiment was conducted, in the same way as the experiment 1, to determine the relationship between the first volume V1 and the occurrence rate of side sparks in the spark plug S2.

Figure 12:
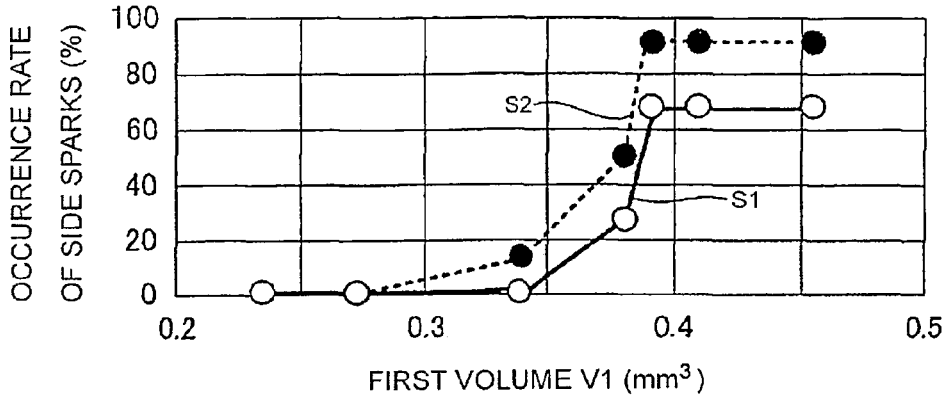
FIG. 12 is a graphical representation showing the relationship between the first volume V1 and the occurrence rate of side sparks in the spark plug of FIG. 11.
Figure 13:
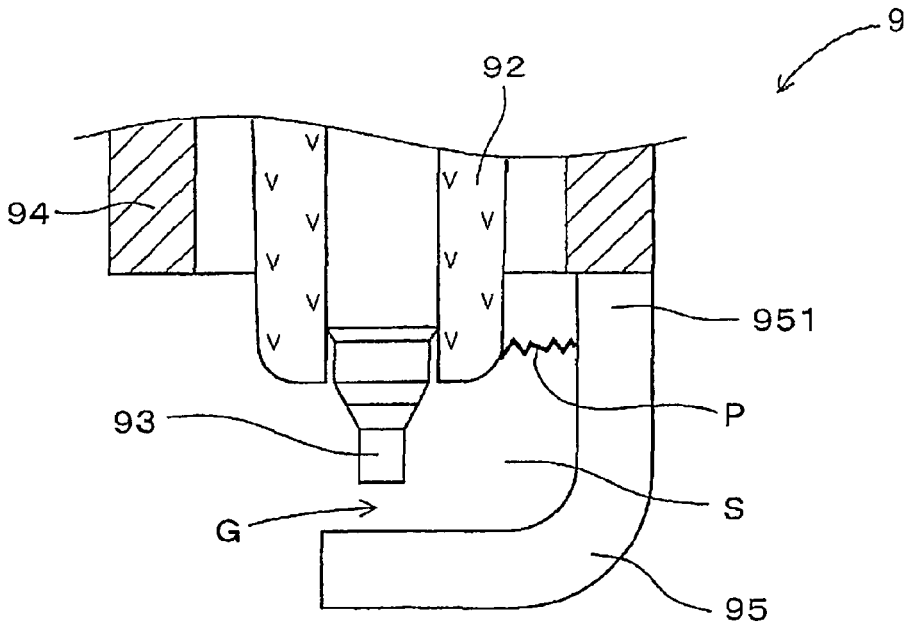
FIG. 13 is an enlarged partially cross-sectional side view showing an end portion of a conventional spark plug.

FIG. 12 shows the experimental results in comparison with those of experiment 1; in the figure, the plots of "●" indicate the results with the spark plug S2, while the plots of "○" indicate those with the spark plug S1.

As seen from FIG. 12, with the spark plug S2, the same tendency was observed as with the spark plug S1. More specifically, when the first volume V1 was not greater than 0.38 $mm^3$, side sparks were also considerably suppressed in the spark plug S2.

However, at the same time, the overall occurrence rate of side sparks in the spark plug S2 became higher than that in the spark plug S1. This is because the required ignition voltage of the spark plug S2 became higher than that of the spark plug S1 due to the absence of the discharge member 53.

While the above particular embodiments of the invention have been shown and described, it will be understood by those who practice the invention and those skilled in the art that various modifications, changes, and improvements may be made to the invention without departing from the spirit of the disclosed concept.

Such modifications, changes, and improvements within the skill of the art are intended to be covered by the appended claims.

What is claimed is:

1. A spark plug comprising:

a tubular metal shell having an end;

an insulator having a length and a first end and a second end that are opposite to each other in a lengthwise direction of said insulator, said insulator also having a bore that extends in the lengthwise direction of said insulator, said insulator being fixed in said metal shell such that the first end thereof protrudes from the end of said metal shell;

a center electrode secured in the bore of said insulator, said center electrode having an end that protrudes from the first end of said insulator; and a ground electrode having a base end joined to the end of said metal shell and a tip portion that faces the end of said center electrode in the lengthwise direction of said insulator through a spark gap, wherein said insulator increases in outer diameter from an edge of an inner surface of said insulator at the first end of said insulator to a first reference plane that is defined to extend perpendicular to the lengthwise direction of said insulator and away 0.1 mm from the edge of the inner surface of said insulator toward the second end of said insulator in the lengthwise direction, and wherein a first volume V1, which is a volume of a portion of said insulator between the edge of the inner surface of said insulator and the first reference plane, is in a range of 0.15 to 0.38 $mm^3$.

2. The spark plug as set forth in claim 1, wherein the first volume V1 is in a range of 0.15 to 0.34 $mm^3$.

3. The spark plug as set forth in claim 1, wherein said insulator increases in outer diameter from the edge of the inner surface of said insulator at the first end of said insulator to a second reference plane that is defined to extend perpendicular to the lengthwise direction of said insulator and away 0.2 mm from the edge of the inner surface of said insulator toward the second end of said insulator in the lengthwise direction, and wherein a second volume V2, which is a volume of a portion of said insulator between the edge of the inner surface of said insulator and the second reference plane, is in a range of 0.5 to 0.84 $mm^3$.

4. The spark plug as set forth in claim 3, wherein the second volume V2 is in a range of 0.5 to 0.79 $mm^3$.

5. The spark plug as set forth in claim 1, wherein said insulator increases in outer diameter from the edge of the inner surface of said insulator at the first end of said insulator to a third reference plane that is defined to extend perpendicular to the lengthwise direction of said insulator and away 0.3 mm from the edge of the inner surface of said insulator toward the second end of said insulator in the lengthwise direction, and wherein a third volume V3, which is a volume of a portion of said insulator between the edge of the inner surface of said insulator and the third reference plane, is in a range of 0.8 to 1.42 $mm^3$.

6. The spark plug as set forth in claim 5, wherein the third volume V3 is in a range of 0.8 to 1.39 $mm^3$.

7. The spark plug as set forth in claim 1, wherein a minimum distance C between an inner surface of said metal shell and an outer surface of said insulator on a fourth reference plane, which is defined to extend perpendicular to the lengthwise direction of said insulator through an inner edge of the end of said metal shell, is in a range of 0.4 to 1.6 mm.

8. The spark plug as set forth in claim 1, wherein said center electrode comprises a base member and a discharge member, the discharge member having a length with a first end representing the end of said center electrode and a second end joined to the base member, and wherein a cross sectional area S1 of the discharge member, which is perpendicular to a lengthwise direction of the discharge member, is in a range of 0.1 to 0.8 $mm^2$; and a distance F1 from the first end of the discharge member to the base member in the lengthwise direction of the discharge member is in a rang of 0.3 to 1.5 mm.

9. The spark plug as set forth in claim 8, wherein the discharge member of said center electrode is made of an Ir-based alloy that includes Ir in an amount of greater than 50 weight percent and at least one additive and has a melting point of greater than 2000° C.

10. The spark plug as set forth in claim 9, wherein the at least one additive is selected from Pt, Rh, Ni, W, Pd, Ru, Re, Al, $Al_2O_3$, Y, and $Y_2O_3$.

11. The spark plug as set forth in claim 1, wherein said ground electrode comprises a base member and a discharge member, the discharge member having a length with a first end facing the end of said center electrode and a second end joined to the base member, and wherein a cross sectional area S2 of the discharge member, which is perpendicular to a lengthwise direction of the discharge member, is in a range of 0.1 to 0.8 $mm^2$; and a distance F2 from the first end of the discharge member to the base member in the lengthwise direction of the discharge member is in a range of 0.3 to 1.5 mm.

12. The spark plug as set forth in claim 11, wherein the discharge member of said ground electrode is made of a Pt-based alloy that includes Pt in an amount of greater than 50 weight percent and at least one additive and has a melting point of greater than 1500° C.

13. The spark plug as set forth in claim 12, wherein the at least one additive is selected from Ir, Rh, Ni, W, Pd, Ru, and Re.

14. The spark plug as set forth in claim 1, wherein a minimum wall thickness T of said insulator on a fourth reference plane, which is defined to extend perpendicular to the lengthwise direction of said insulator through an inner edge of the end of said metal shell, is in a range of 0.3 to 1.8 mm.

15. The spark plug as set forth in claim 14, wherein an outer diameter d of said center electrode on the fourth reference plane is in a range of 0.8 to 2.6 mm.

* * * * *